US011687038B2

(12) United States Patent
Kobayashi et al.

(10) Patent No.: US 11,687,038 B2
(45) Date of Patent: Jun. 27, 2023

(54) WATCH OUTER PACKAGING COMPONENT AND WATCH

(71) Applicant: Seiko Epson Corporation, Tokyo (JP)

(72) Inventors: Atsushi Kobayashi, Shiojiri (JP); Yoshio Mishima, Matsumoto (JP)

(73) Assignee: SEIKO EPSON CORPORATION

( * ) Notice: Subject to any disclaimer, the term of this patent is extended or adjusted under 35 U.S.C. 154(b) by 364 days.

(21) Appl. No.: 17/118,851

(22) Filed: Dec. 11, 2020

(65) Prior Publication Data

US 2021/0181686 A1 Jun. 17, 2021

(30) Foreign Application Priority Data

Dec. 13, 2019 (JP) ..... 2019-225197

(51) Int. Cl.

| | |
|---|---|
| ***G04B 37/22*** | (2006.01) |
| ***G04G 17/08*** | (2006.01) |
| ***C22C 38/20*** | (2006.01) |
| ***C22C 38/22*** | (2006.01) |
| ***C22C 38/26*** | (2006.01) |

(52) U.S. Cl.

CPC ..... *G04B 37/22* (2013.01); *C22C 38/20* (2013.01); *C22C 38/22* (2013.01); *C22C 38/26* (2013.01); *G04G 17/08* (2013.01)

(58) Field of Classification Search

None

See application file for complete search history.

(56) References Cited

U.S. PATENT DOCUMENTS

| | | | | |
|---|---|---|---|---|
| 7,875,128 | B2 | 1/2011 | Kuroda et al. | |
| 2006/0130938 | A1* | 6/2006 | Kramer | C22C 38/02 419/36 |
| 2007/0217293 | A1 | 9/2007 | Takasawa | |
| 2009/0073815 | A1 | 3/2009 | Takasawa | |
| 2017/0088912 | A1 | 3/2017 | Fukuda et al. | |

FOREIGN PATENT DOCUMENTS

| | | | |
|---|---|---|---|
| JP | 2000-155182 | A | 6/2000 |
| JP | 2005-097682 | A | 4/2005 |
| JP | 2007-056301 | A | 3/2007 |
| JP | 2007-239060 | A | 9/2007 |
| JP | 2007-248397 | A | 9/2007 |
| JP | 2009-069049 | A | 4/2009 |
| JP | 2013-101157 | A | 5/2013 |
| WO | 2021-100687 | A1 | 5/2021 |

* cited by examiner

*Primary Examiner* — Seth Dumbris
*Assistant Examiner* — Kim S. Horger
(74) *Attorney, Agent, or Firm* — Harness, Dickey & Pierce, P.L.C.

(57) ABSTRACT

A watch outer packaging component is a watch outer packaging component formed of austenitized ferritic stainless steel including a base formed of a ferrite phase and a surfacing layer formed of an austenitized phase in which the ferrite phase is austenitized, the watch outer packaging component abutting on a sealing member that partitions between a space inside a watch and a space outside the watch, wherein the surfacing layer includes an outer surfacing layer provided at an outer surface facing the space outside the watch, and an inner surfacing layer provided at an inner surface facing the space inside the watch, and the inner surfacing layer is thinner in thickness than the outer surfacing layer.

20 Claims, 8 Drawing Sheets

WATCH OUTER PACKAGING COMPONENT AND WATCH

The present application is based on, and claims priority from JP Application Serial Number 2019-225197, filed Dec. 13, 2019, the disclosure of which is hereby incorporated by reference herein in its entirety.

BACKGROUND

1. Technical Field

The present disclosure relates to a watch outer packaging component, a watch, and a method for manufacturing a watch outer packaging component.

2. Related Art

JP 2009-69049 A discloses a watch housing using ferritic stainless steel in which a surfacing layer is austenitized by nitrogen absorption treatment, specifically, a case band and a case back.

In JP 2009-69049 A, austenitization of the surfacing layer of ferritic stainless steel results in hardness and corrosion resistance required as a watch housing.

However, in JP 2009-69049 A, on an inner side of the watch housing as well, a surfacing layer similar to that on an outer side is formed, and thus when the housing is made to have a predetermined thickness, for example, about 4 mm, a thickness of an inner layer portion formed of a ferrite phase decreases, thereby deteriorating an antimagnetic performance.

On the other hand, when the thickness of the watch housing is increased in order to thicken the inner layer portion, the watch increases in size.

In other words, JP 2009-69049 A has a problem in that it is difficult, while maintaining a predetermined size as the watch, to ensure desired antimagnetic performance.

SUMMARY

A watch outer packaging component of the present disclosure is a watch outer packaging component formed of austenitized ferritic stainless steel including a base formed of a ferrite phase and a surfacing layer formed of an austenitized phase in which the ferrite phase is austenitized, the watch outer packaging component abutting on a sealing member that partitions between a space inside a watch and a space outside the watch, wherein the surfacing layer includes an outer surfacing layer provided at an outer surface facing the space outside the watch, and an inner surfacing layer provided at an inner surface facing the space inside the watch, and the inner surfacing layer is thinner in thickness than the outer surfacing layer.

A watch outer packaging component of the present disclosure is a watch outer packaging component formed of austenitized ferritic stainless steel including a base formed of a ferrite phase and a surfacing layer formed of an austenitized phase in which the ferrite phase is austenitized, the watch outer packaging component abutting on a sealing member that partitions between a space inside a watch and a space outside the watch, wherein the surfacing layer includes an outer surfacing layer provided at an outer surface facing the space outside the watch, and the surfacing layer is not provided at an inner surface facing the space inside the watch.

A watch outer packaging component of the present disclosure is a watch outer packaging component formed of austenitized ferritic stainless steel including a base formed of a ferrite phase and a surfacing layer formed of an austenitized phase in which the ferrite phase is austenitized, wherein the surfacing layer includes a first surfacing layer provided at an inner surface facing a space inside a watch, and a second surfacing layer provided at an outer surface facing a space outside the watch, and the first surfacing layer is thinner in thickness than the second surfacing layer.

A watch including a watch outer packaging component of the present disclosure.

A method for manufacturing a watch outer packaging component of the present disclosure is a method for manufacturing a watch outer packaging component formed of austenitized ferritic stainless steel including a base formed of a ferrite phase and a surfacing layer formed of an austenitized phase in which the ferrite phase is austenitized, the watch outer packaging component abutting on a sealing member that partitions between a space inside the watch and a space outside the watch, that includes a first processing step for processing ferritic stainless steel to form a base material, a heat treatment step for performing nitrogen absorption treatment on the base material to form the surfacing layer, and a second processing step for cutting the surfacing layer to form the watch outer packaging component, wherein in the second processing step, an inner surfacing layer, of the surfacing layer, provided on an inner surface facing a space inside the watch is cut so as to be thinner in thickness than an outer surfacing layer provided on an outer surface facing a space outside the watch.

DESCRIPTION OF EXEMPLARY EMBODIMENTS

First Exemplary Embodiment

A watch 1 of a first exemplary embodiment of the present disclosure will be described below with reference to the drawings.

Figure 1:
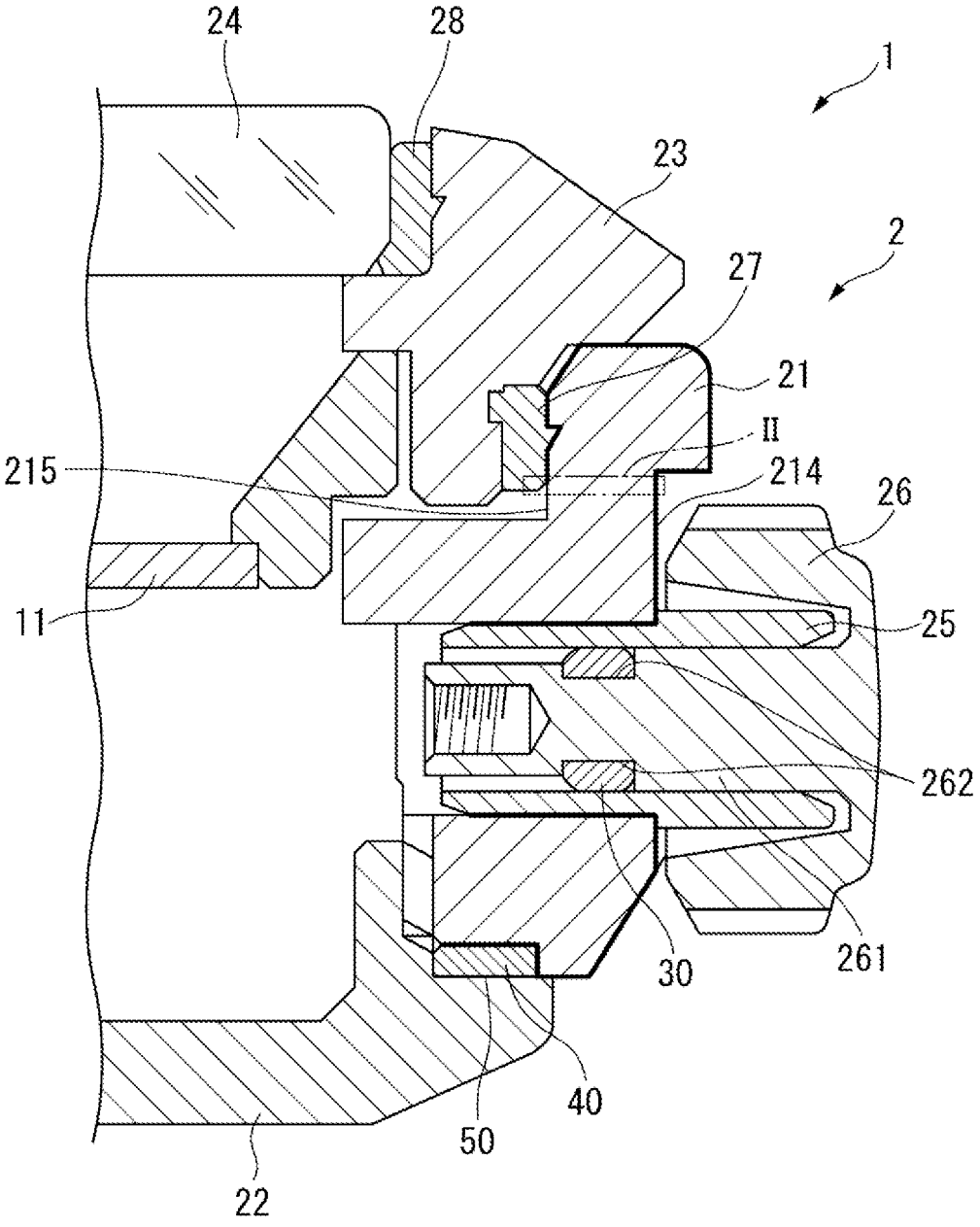
FIG. 1 is a partial cross-sectional view schematically illustrating a watch of a first exemplary embodiment.

FIG. 1 is a partial cross-sectional view schematically illustrating the watch 1 of the present exemplary embodiment.

As illustrated in FIG. 1, the watch 1 includes an outer packaging case 2. The outer packaging case 2 includes a cylindrical case main body 21, a case back 22 fixed to a back surface side of the case main body 21, an annular bezel 23 fixed to a front surface side of the case main body 21, and a glass plate 24 held by the bezel 23. Furthermore, a dial 11 and a movement (not illustrated) are housed in the case main body 21. Note that, the case main body 21 is an example of a watch outer packaging component of the present disclosure.

A winding stem pipe 25 fits into and is fixed to the case main body 21, and a shaft portion 261 of a crown 26 is rotatably inserted into the winding stem pipe 25.

The case main body 21 and the bezel 23 engage with each other via a plastic packing 27, and the bezel 23 and the glass plate 24 are fixed to each other by a plastic packing 28.

Furthermore, the case back 22 is fitted into or screwed with the case main body 21, and a ring-shaped rubber packing or case back packing 40 is interposed in a seal portion 50 in a compressed state. With this configuration, the seal portion 50 is liquid-tightly sealed, and a waterproof function is obtained.

Here, in the present exemplary embodiment, the winding stem pipe 25, the plastic packing 27, and the case back packing 40 partition a space in which the movement and the like of the case main body 21 are housed, that is, a space inside the watch, and a space outside the case main body 21, that is, a space outside the watch. In other words, the winding stem pipe 25, the plastic packings 27 and 28, and the case back packing 40 are an example of a sealing member of the present disclosure that abuts on the case main body 21.

A groove 262 is formed at an outer periphery halfway the shaft portion 261 of the crown 26, and a ring-shaped rubber packing 30 is fitted into the groove 262. The rubber packing 30 adheres to an inner circumferential surface of the winding stem pipe 25, and is compressed between the inner circumferential surface and an inner surface of the groove 262. According to this configuration, a gap between the crown 26 and the winding stem pipe 25 is liquid-tightly sealed and a waterproof function is obtained. Note that, when the crown 26 is rotated and operated, the rubber packing 30 rotates together with the shaft portion 261 and, slides in a circumferential direction while adhering to the inner circumferential surface of the winding stem pipe 25.

Case Main Body

Figure 2:
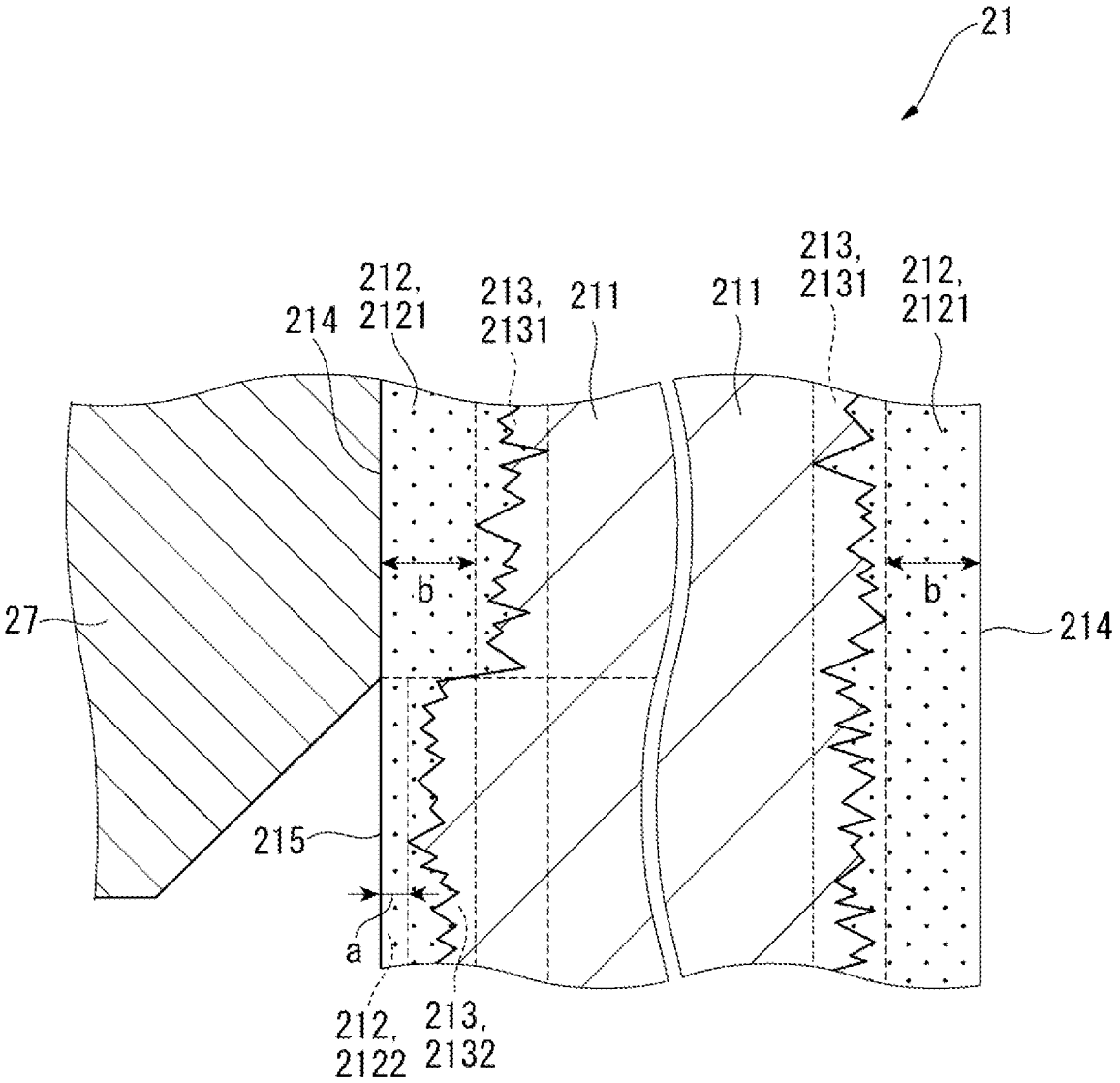
FIG. 2 is a cross-sectional view illustrating a main part of a case main body of the first exemplary embodiment.

FIG. 2 is an enlarged cross-sectional view of a main part of the case main body 21, specifically, a region II in FIG. 1.

As illustrated in FIG. 2, the case main body 21 is formed of ferritic stainless steel including a base 211 formed of a ferrite phase, a surfacing layer 212 formed of an austenite phase (hereinafter, an austenitized phase) in which the ferrite phase is austenitized, and a mixed layer 213 in which the ferrite phase and the austenitized phase are mixed with each other.

Base

The base 211 contains, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of ferritic stainless steel formed of Fe and unavoidable impurities.

Cr is an element that increases a transfer rate of nitrogen to the ferrite phase, and a diffusion rate of nitrogen in the ferrite phase, in nitrogen absorption treatment. When Cr is less than 18%, the transfer rate and diffusion rate of nitrogen decrease. Furthermore, when Cr is less than 18%, corrosion resistance of the surfacing layer 212 deteriorates. On the other hand, when Cr exceeds 22%, hardening occurs, and workability as a material worsens. Furthermore, when Cr exceeds 22%, anaesthetic appearance is spoiled. Thus, Cr content may be 18 to 22%, may be 20 to 22%, and may be 19.5 to 20.5%.

Mo is an element that increases the transfer rate of nitrogen to the ferrite phase, and the diffusion rate of nitrogen in the ferrite phase, in the nitrogen absorption treatment. When Mo is less than 1.3%, the transfer rate and diffusion rate of nitrogen decrease. Furthermore, when Mo is less than 1.3%, corrosion resistance as a material deteriorates. On the other hand, when Mo exceeds 2.8%, hardening occurs, and the workability as the material worsens. Furthermore, when Mo exceeds 2.8%, a configuration organization of the surfacing layer 212 becomes significantly heterogeneous, and the aesthetic appearance is spoiled. Thus, Mo content may be 1.3 to 2.8%, may be 1.8 to 2.8%, and may be 2.25 to 2.35%.

Nb is an element that increases the transfer rate of nitrogen to the ferrite phase, and the diffusion rate of nitrogen in the ferrite phase, in the nitrogen absorption treatment. When Nb is less than 0.05%, the transfer rate and diffusion rate of nitrogen decrease. On the other hand, when Nb exceeds 0.50%, hardening occurs, and the workability as the material worsens. Furthermore, a deposition section is generated, and the aesthetic appearance is spoiled. Thus, Nb content may be 0.05 to 0.50%, may be 0.05 to 0.35%, and may be 0.15 to 0.25%.

Cu is an element that controls absorption of nitrogen in the ferrite phase in the nitrogen absorption treatment. When Cu is less than 0.1%, a variation in a nitrogen content in the ferrite phase increases. On the other hand, when Cu exceeds 0.8%, the transfer rate of nitrogen to the ferrite phase decreases. Thus, the Cu content may be 0.1 to 0.8%, may be 0.1 to 0.2%, and may be 0.1 to 0.15%.

Ni is an element that inhibits the transfer of nitrogen to the ferrite phase, and the diffusion of nitrogen in the ferrite phase, in the nitrogen absorption treatment. When Ni is equal to or greater than 0.5%, the transfer rate and the diffusion rate of nitrogen decrease. Furthermore, it is possible that corrosion resistance worsens, and that it becomes difficult to prevent occurrence of a metal allergy and the like. Thus, Ni content may be less than 0.5%, may be less than 0.2%, and may be less than 0.1%.

Mn is an element that inhibits the transfer of nitrogen to the ferrite phase, and the diffusion of nitrogen in the ferrite phase, in the nitrogen absorption treatment. When Mn is equal to or greater than 0.8%, the transfer rate and the diffusion rate of nitrogen decrease. Thus, Mn content may be less than 0.8%, may be less than 0.5%, and may be less than 0.1%.

Si is an element that inhibits the transfer of nitrogen to the ferrite phase, and the diffusion of nitrogen in the ferrite phase, in the nitrogen absorption treatment. When Si is equal to or greater than 0.5%, the transfer rate and the diffusion rate of nitrogen decrease. Thus, Si content may be less than 0.5%, and may be less than 0.3%.

P is an element that inhibits the transfer of nitrogen to the ferrite phase, and the diffusion of nitrogen in the ferrite phase, in the nitrogen absorption treatment. When P is equal to or greater than 0.10%, the transfer rate and the diffusion rate of nitrogen decrease. Thus, P content may be less than 0.10%, and may be less than 0.03%.

S is an element that inhibits the transfer of nitrogen to the ferrite phase, and the diffusion of nitrogen in the ferrite phase, in the nitrogen absorption treatment. When S is equal to or greater than 0.05%, the transfer rate and the diffusion rate of nitrogen decrease. Thus, S content may be less than 0.05%, and may be less than 0.01%.

N is an element that inhibits the transfer of nitrogen to the ferrite phase, and the diffusion of nitrogen in the ferrite phase, in the nitrogen absorption treatment. When N is equal to or greater than 0.05%, the transfer rate and the diffusion rate of nitrogen decrease. Thus, N content may be less than 0.05%, and may be less than 0.01%.

C is an element that inhibits the transfer of nitrogen to the ferrite phase, and the diffusion of nitrogen in the ferrite phase, in the nitrogen absorption treatment. When C is equal to or greater than 0.05%, the transfer rate and the diffusion rate of nitrogen decrease. Thus, C content may be less than 0.05%, and may be less than 0.02%.

Note that, the base 211 is not limited to the configuration described above, and it is sufficient that the base 211 is formed of the ferrite phase.

Surfacing Layer

The surfacing layer 212 is provided by performing the nitrogen absorption treatment on the base material forming the base 211, to austenitize the ferrite phase. In the present exemplary embodiment, a nitrogen content in the surfacing layer 212 is set to 1.0 to 1.6% in percent by mass. In other words, nitrogen is contained at high concentrations in the surfacing layer 212. Accordingly, anticorrosive performance in the surfacing layer 212 can be improved.

In addition, in the present exemplary embodiment, the surfacing layer 212 includes an outer surfacing layer 2121 and an inner surfacing layer 2122. The outer surfacing layer 2121 is the surfacing layer 212 provided outside the plastic packing 27, that is, on an outer surface 214 facing the space outside the watch. In addition, the inner surfacing layer 2122 is the surfacing layer 212 provided inside the plastic packing 27, that is, on an inner surface 215 facing the space inside the watch.

Here, in FIG. 1, the outer surface 214 of the outer surfacing layer 2121 is denoted by a thick line. Additionally, in the present exemplary embodiment, a surface of the case main body 21 that contacts the plastic packing 27 is referred to as the outer surface 214 facing an outside of the watch.

Note that, the inner surfacing layer 2122 is an example of a first surfacing layer of the present disclosure, and the outer surfacing layer 2121 is an example of a second surfacing layer of the present disclosure.

Here, in the present exemplary embodiment, the inner surfacing layer 2122 is provided such that a thickness a is thinner than a thickness b of the outer surfacing layer 2121. Specifically, the thickness a of the inner surfacing layer 2122 is set to approximately 40 μm, and the thickness b of the outer surfacing layer 2121 is set to approximately 350 μm.

Note that, the outer surfacing layer 2121 is not limited to the configuration described above. For example, the thickness b of the outer surfacing layer 2121 may be set to equal to or greater than 350 μm, and may be set to equal to or greater than 100 μm and equal to or less than 600 μm. With the configuration described above, it is possible to ensure predetermined corrosion resistance, and it is possible to prevent a nitrogen absorption treatment time from becoming too long. Further, the inner surfacing layer 2122 is not limited to the configuration described above. For example, the thickness a of the inner surfacing layer 2122 may be set to equal to or greater than 40 μm, and may be set to equal to or less than 100 μm.

In addition, each of the thicknesses a and b is a thickness of a layer formed of the austenitized phase, and, for example, in a visual field when SEM observation is performed at a magnification of 500 to 1000, is a shortest distance from the outer surface 214 to a ferrite phase of an outer mixed layer 2131 described below, or a shortest distance from the inner surface 215 to a ferrite phase of an inner mixed layer 2132 described below. Alternatively, a shallowest austenitized phase from the outer surface 214 or a shallowest austenitized phase from the inner surface 215. Additionally, when a distance from the outer surface 214 or the inner surface 215 to each of a plurality of points that is short in distance to the ferrite phase is measured, an average value thereof may be defined as the thickness a of the outer surfacing layer 2121 or the thickness b of the inner surfacing layer 2122.

Mixed Layer

In a step of forming the surfacing layer 212, the mixed layer 213 is generated by a variation in transfer rate of nitrogen entering the base 211 formed of the ferrite phase. In other words, at a location where the transfer rate of nitrogen is high, nitrogen enters into a deep location of the ferrite phase and the location is austenitized, and at a location where the transfer rate of nitrogen is low, the ferrite phase is austenitized only up to a shallow location, thus the mixed layer 213 is formed in which the ferrite phase and the austenitized phase are mixed with each other with respect to a depth direction. Note that, the mixed layer 213 is a layer including a shallowest site to a deepest site of the austenitized phase when viewed in a cross-section, and is a layer thinner than the surfacing layer 212.

Here, in the present exemplary embodiment, the mixed layer 213 includes the outer mixed layer 2131 and the inner mixed layer 2132. The outer mixed layer 2131 is a layer formed between the base 211 and the outer surfacing layer 2121. In addition, the inner mixed layer 2132 is a layer formed between the base 211 and the inner surfacing layer 2122.

Method for Manufacturing Case Main Body

Next, a method for manufacturing the case main body 21 will be described.

Figure 3:
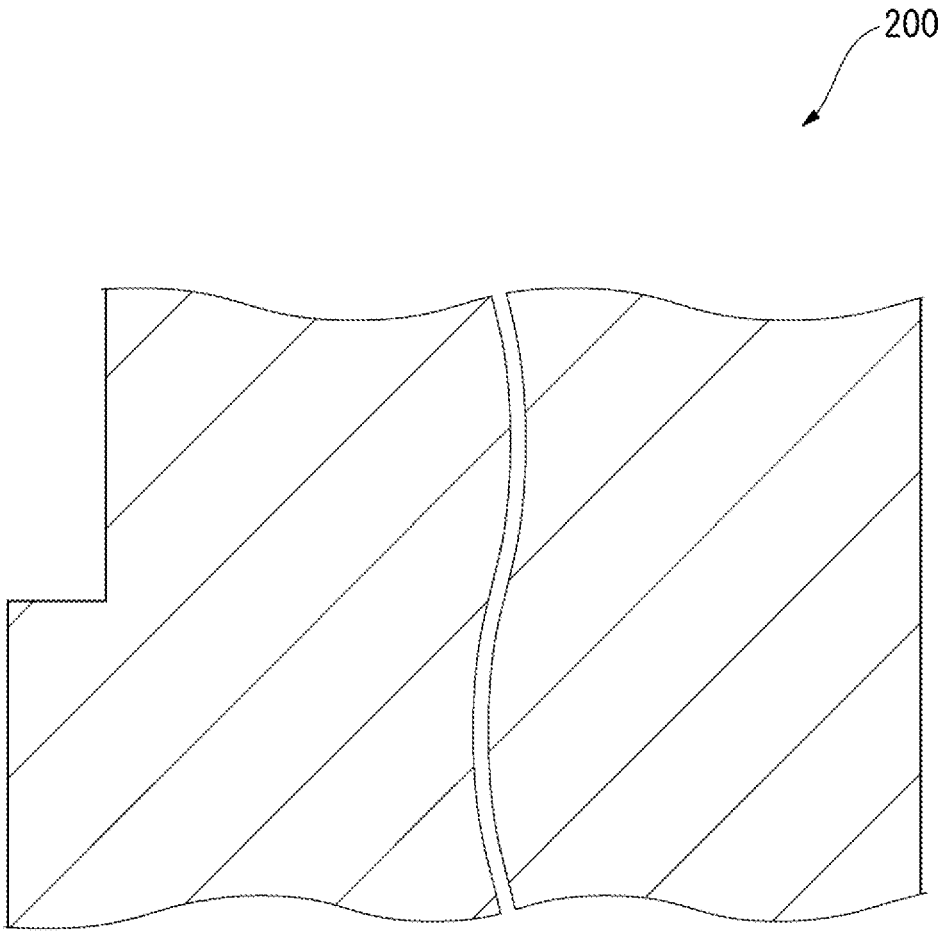
FIG. 3 is a schematic diagram illustrating a manufacturing step of the case main body of the first exemplary embodiment.
Figure 4:
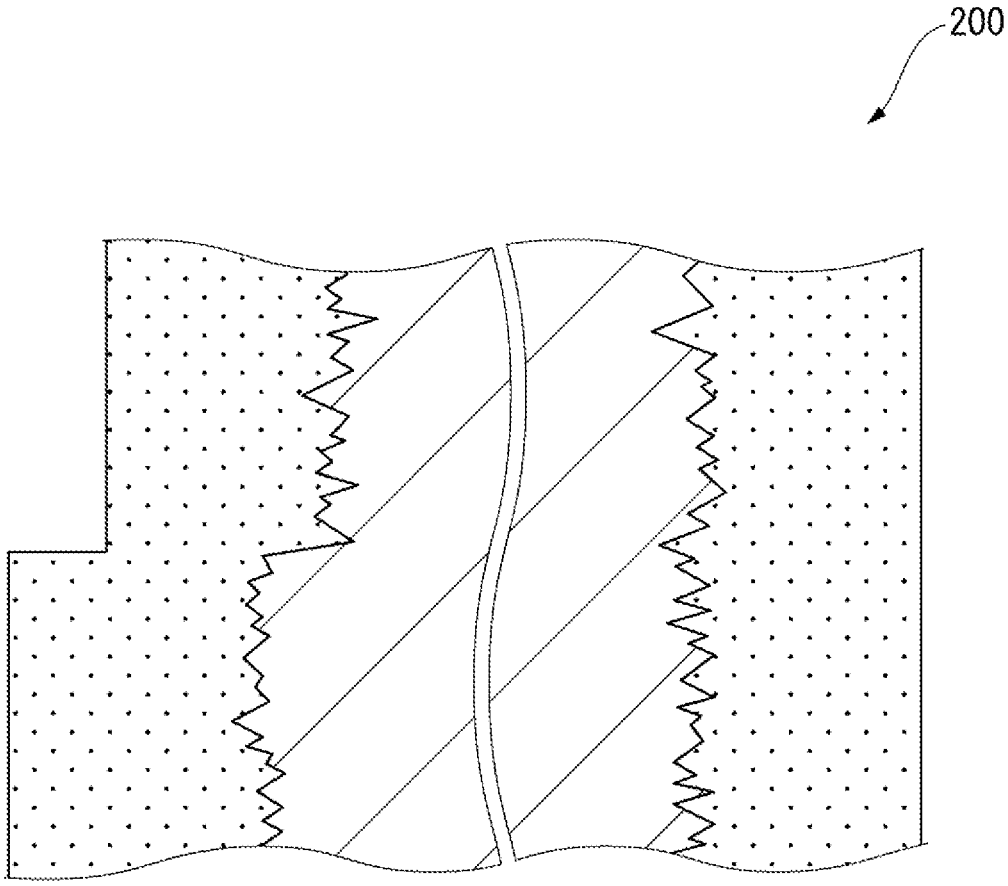
FIG. 4 is a schematic diagram illustrating a manufacturing step of the case main body of the first exemplary embodiment.
Figure 5:
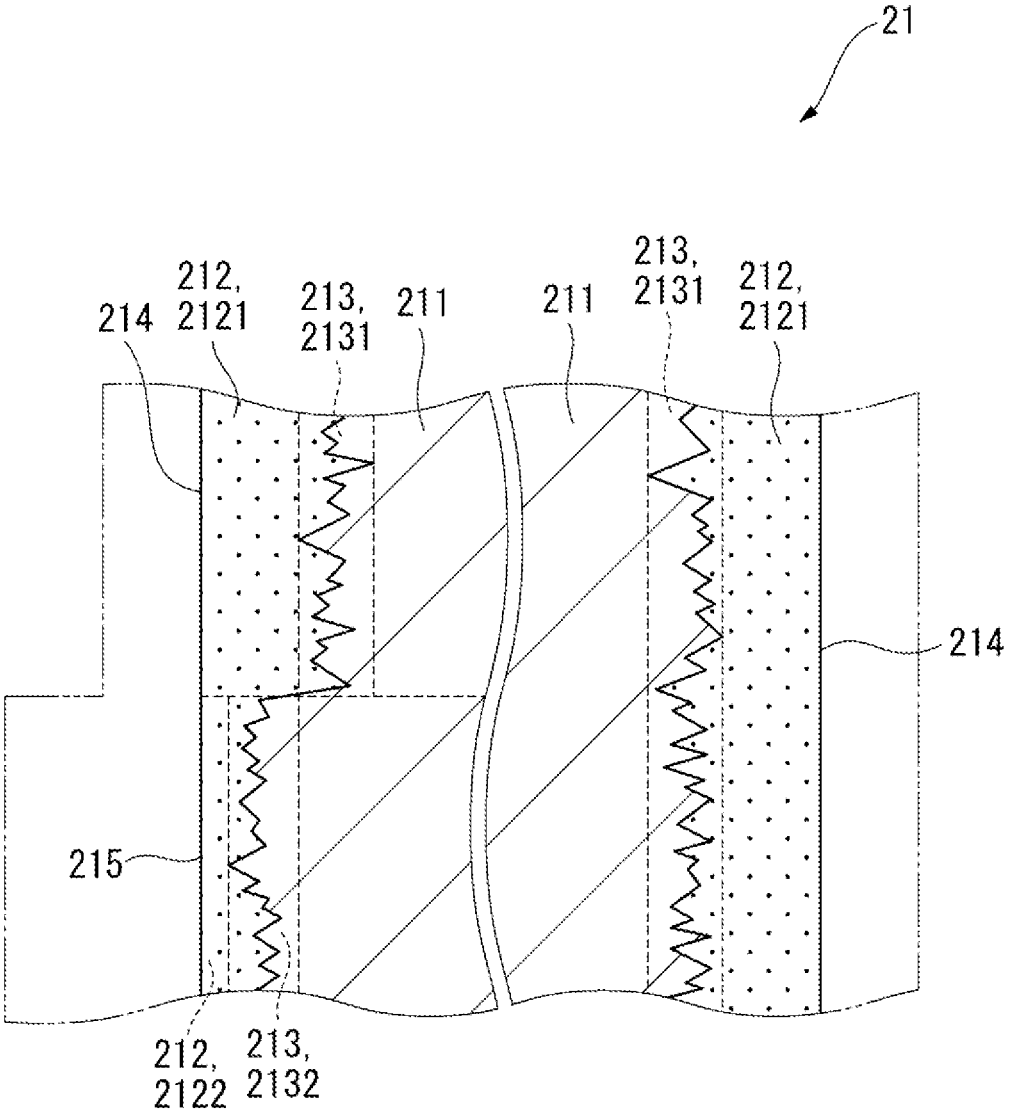
FIG. 5 is a schematic diagram illustrating a manufacturing step of the case main body of the first exemplary embodiment.

FIGS. 3 to 5 are schematic diagrams each illustrating a manufacturing step of the case main body 21.

As illustrated in FIG. 3, first, ferritic stainless steel is subjected to a machine process to form a base material 200. At this time, ferritic stainless steel is cut such that a thickness of a location corresponding to the inner surfacing layer 2122 is larger than a thickness of a location corresponding to the outer surfacing layer 2121 by a predetermined dimension.

Note that, the step of processing ferritic stainless steel to form the base material 200 is an example of a first processing step of the present disclosure.

Next, as illustrated in FIG. 4, the nitrogen absorption treatment is performed on the base material 200 processed as described above. Accordingly, nitrogen enters the base material 200 from a surface, the ferrite phase is austenitized, and a layer corresponding to the surfacing layer 212 is formed.

Note that, the step of performing the nitrogen absorption treatment on the base material 200 to form the surfacing layer is an example of a heat treatment step of the present disclosure.

Finally, as illustrated in FIG. 5, by cutting the layer corresponding to the surfacing layer 212 of the base material 200 by a predetermined amount, the case main body 21 as described above is formed. At this time, in the present exemplary embodiment, the cutting is performed such that the inner surfacing layer 2122 is thinner in thickness than the outer surfacing layer 2121. Specifically, the base material 200 is cut such that the thickness of the inner surfacing layer 2122 is approximately 100 μm, and the thickness of the outer surfacing layer 2121 is approximately 350 μm.

Note that, the step for cutting the base material 200 to form the case main body 21 is an example of a second processing step of the present disclosure.

Advantageous Effects of First Exemplary Embodiment

According to the first exemplary embodiment, the following advantageous effects can be produced.

The case main body 21 of the present exemplary embodiment is formed of austenitized ferritic stainless steel including the base 211 formed of the ferrite phase, and the surfacing layer 212 formed of the austenitized phase in which the ferrite phase is austenitized. Then, the surfacing layer 212 includes the outer surfacing layer 2121 provided on the outer surface 214 facing the space outside the watch, and the inner surfacing layer 2122 provided on the inner surface 215 facing the space inside the watch, and the inner surfacing layer 2122 is thinner in thickness than the outer surfacing layer 2121.

Accordingly, the thickness of the inner surfacing layer 2122 is reduced, and thus, the outer surfacing layer 2121 can be made to have a thickness with which predetermined anticorrosive performance is obtained without increasing a thickness as the case main body 21, and the base 211 can be made to have a thickness with which predetermined antimagnetic performance is obtained. Thus, while a predetermined size as the watch 1 is maintained, desired antimagnetic performance can be ensured.

Furthermore, in the present exemplary embodiment, the thickness of the inner surfacing layer 2122 is decreased, thus a distance between the movement housed in the case main body 21 and the base 211 formed of the ferrite phase can be shortened. Accordingly, influence of an external magnetic field on a motor or the like provided in the movement can be reduced, and the antimagnetic performance can be improved.

In the present exemplary embodiment, the thickness of the inner surfacing layer 2122 is equal to or less than 100 μm.

Accordingly, the distance between the movement housed in the case main body 21, and the base 211 formed of the ferrite phase can be shortened, thereby improving the antimagnetic performance.

In the present exemplary embodiment, the thickness of the outer surfacing layer 2121 is equal to or greater than 100 μm and equal to or less than 600 μm.

Accordingly, the predetermined anticorrosive performance can be ensured, and it is possible to prevent the nitrogen absorption treatment time from becoming too long.

In the present exemplary embodiment, the mixed layer 213 is included that is formed between the base 211 and the surfacing layer 212 and in which the ferrite phase and the austenitized phase are mixed with each other.

Accordingly, in the nitrogen absorption treatment, a variation in the transfer rate of nitrogen can be tolerated, thereby making it possible to facilitate the nitrogen absorption treatment.

In the present exemplary embodiment, the base 211 contains, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities.

This makes it possible to increase the transfer rate of nitrogen to the ferrite phase, and the diffusion rate of nitrogen in the ferrite phase, in the nitrogen absorption treatment.

In the present exemplary embodiment, the nitrogen content of the surfacing layer 212 is 1.0 to 1.6% in percent by mass.

Accordingly, anticorrosive performance in the surfacing layer 212 can be improved.

Second Exemplary Embodiment

Next, a second exemplary embodiment will be described based on FIG. 6.

The second exemplary embodiment differs from the first exemplary embodiment described above in that an inner surfacing layer and an inner mixed layer are not provided.

Note that, an identical configuration to that in the first exemplary embodiment will be given an identical reference numeral and detailed description will be omitted.

Figure 6:
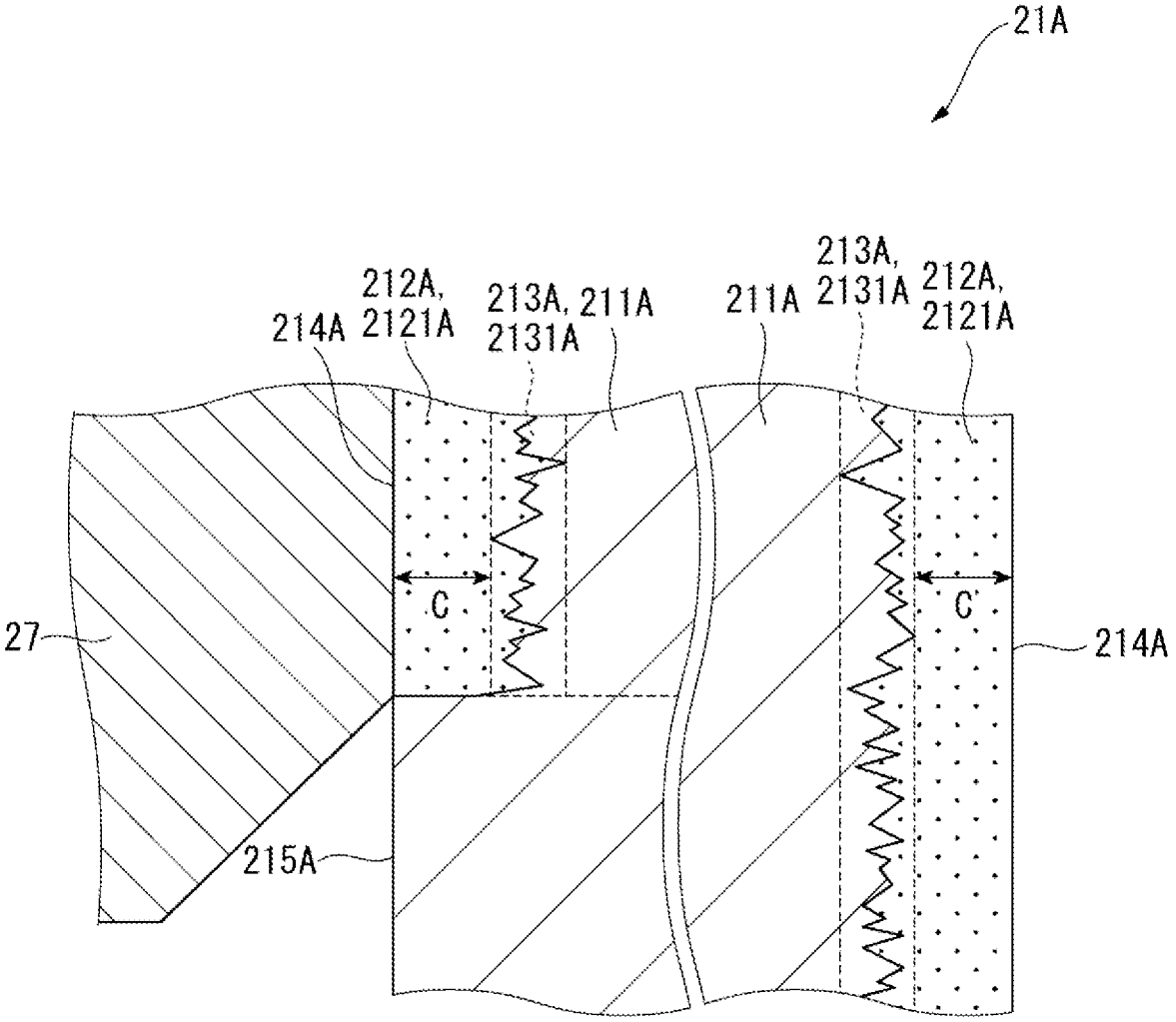
FIG. 6 is a cross-sectional view illustrating a main part of a case main body of a second exemplary embodiment.

FIG. 6 is a cross-sectional view illustrating a main part of a case main body 21A of the second exemplary embodiment.

As illustrated in FIG. 6, the case main body 21A is formed of ferritic stainless steel including a base 211A formed of a ferrite phase, a surfacing layer 212A formed of an austenitized phase, and a mixed layer 213A in which the ferrite phase and the austenitized phase are mixed with each other.

The base 211A is formed of ferritic stainless steel as in the case of the base 211 of the first exemplary embodiment described above.

Further, similar to the surfacing layer 212 of the first exemplary embodiment described above, the surfacing layer 212A is provided by austenitizing the ferrite phase forming the base 211A.

Further, similar to the mixed layer 213 of the first exemplary embodiment described above, in a step of forming the surfacing layer 212A, the mixed layer 213A is generated by a variation in transfer rate of nitrogen entering the base 211A formed of the ferrite phase.

In the present exemplary embodiment, the surfacing layer 212A includes an outer surfacing layer 2121A provided on an outer surface 214A facing a space outside a watch. The mixed layer 213A has an outer mixed layer 2131A formed between the outer surfacing layer 2121A and the base 211A.

In the present exemplary embodiment, a thickness c of the outer surfacing layer 2121A is set to approximately 350 μm, similar to the outer surfacing layer 2121 of the first exemplary embodiment described above. Note that, the outer surfacing layer 2121A is not limited to the configuration described above. For example, the thickness c of the outer surfacing layer 2121A may be set to equal to or greater than 350 μm, and may be defined as equal to or greater than 100 μm and equal to or less than 600 μm.

Here, in the present exemplary embodiment, the surfacing layer 212A and the mixed layer 213A are provided only on the outer surface 214A. In other words, the surfacing layer 212A and the mixed layer 213A are not provided on the inner surface 215A, and the base 211A is exposed in a space inside the watch.

Accordingly, a distance between a movement housed in the case main body 21A and the base 211A formed of the ferrite phase can be shortened.

Note that, in the present exemplary embodiment, in the space inside the watch, the base 211A formed of the ferrite phase is exposed, but since the space inside the watch is sealed off from the space outside the watch by the winding stem pipe 25, the plastic packings 27, 28, the case back packing 40, and the like, an effect on corrosion is small.

Advantageous Effects of Second Exemplary Embodiment

According to the second exemplary embodiment described above, the following advantageous effects can be produced.

In the present exemplary embodiment, the surfacing layer 212A includes the outer surfacing layer 2121A provided on the outer surface 214A facing the space outside the watch. Furthermore, the surfacing layer 212A is not provided on the inner surface 215A.

Thus, the outer surfacing layer 2121A can be made to have a thickness with which predetermined anticorrosive performance is obtained without increasing a thickness as the case main body 21A, and the base 211A can be made to have a thickness with which predetermined antimagnetic performance is obtained. Thus, while maintaining a predetermined size as the watch, desired antimagnetic performance can be ensured.

Furthermore, in the present exemplary embodiment, since the surfacing layer 212A is not provided on the inner surface 215A, the distance between the movement housed in the case main body 21A and the base 211A can be shortened. Accordingly, influence of an external magnetic field on a motor or the like provided in the movement can be further reduced, and the antimagnetic performance can be further improved.

Third Exemplary Embodiment

Next, a third exemplary embodiment will be described based on FIG. 7.

The third exemplary embodiment differs from the first exemplary embodiment in that a case main body 21B and a sensor 6B engage with each other via a packing 7B.

Note that, an identical configuration to that in the first and second exemplary embodiments will be given an identical reference numeral and detailed description will be omitted.

Figure 7:
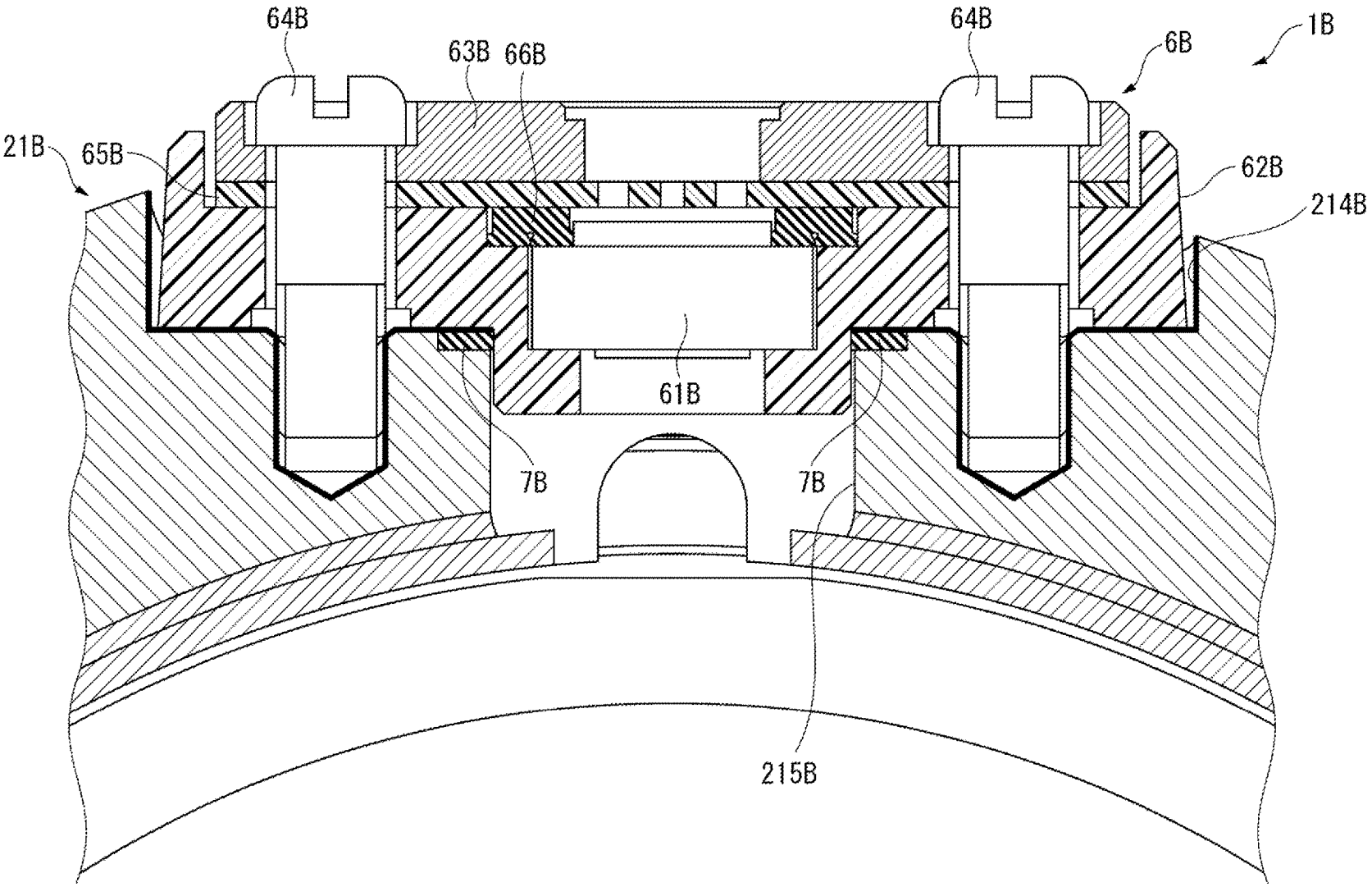
FIG. 7 is a partial cross-sectional view schematically illustrating a watch of a third exemplary embodiment.

FIG. 7 is a partial cross-sectional view schematically illustrating a watch 1B of the third exemplary embodiment. Note that FIG. 7 is a partial cross-sectional view of the watch 1B taken along a direction parallel to the dial 11.

As illustrated in FIG. 7, the watch 1B of the present exemplary embodiment includes the case main body 21B, the sensor 6B, and the packing 7B.

In the present exemplary embodiment, the case main body 21B and the sensor 6B engage with each other via the packing 7B. That is, the packing 7B is an example of a sealing member of the present disclosure.

Sensor

The sensor 6B includes a sensor main body 61B, a sensor housing 62B, a sensor cover 63B, a mounting screw 64B, a foreign material ingress prevention cover 65B, and a waterproof packing 66B, and is configured to be capable of measuring a pressure acting on the watch 1B. In the present exemplary embodiment, the sensor 6B is attached to watch 1B for the purpose of measuring air pressure and water pressure.

Note that, the watch 1B may have, by measuring air pressure and water pressure by the sensor 6B, for example, an altitude estimation function, a weather prediction function, a water depth estimation function, a diving information display function, and the like, based on detected air pressure.

Furthermore, the sensor 6B is not limited to the configuration described above, and, for example, may be configured to be capable of measuring a temperature of the watch 1B.

In the present exemplary embodiment, the sensor main body 61B is housed in the sensor housing 62B attached to the case main body 21B. Then, the sensor main body 61B is fixed to the sensor housing 62B by the waterproof packing 66B. This seals a gap between the sensor main body 61B and the sensor housing 62B.

In this state, the foreign material ingress prevention cover 65B is disposed so as to cover the sensor main body 61B, and the sensor cover 63B is disposed so as to cover the foreign material ingress prevention cover 65B. The sensor cover 63B is attached by the mounting screw 64B to the sensor housing 62B so that the sensor 6B is attached to the case main body 21B.

Here, in the present exemplary embodiment, the case main body 21B is provided with an outer surfacing layer similar to the outer surfacing layer 2121 of the first exemplary embodiment described above, on an outer surface 214B denoted by a thick line in FIG. 7. Furthermore, the case main body 21B is provided with an inner surfacing layer similar to the inner surfacing layer 2122 of the first exemplary embodiment described above, on an inner surface 215B. In other words, the inner surface 215B is provided with the inner surfacing layer thinner in thickness than the outer surfacing layer provided on the outer surface 214B.

Advantageous Effects of Third Exemplary Embodiment

According to the third exemplary embodiment described above, the following advantageous effects can be produced.

In the present exemplary embodiment, the case main body 21B is provided with the inner surfacing layer thinner in thickness than the outer surfacing layer, on the inner surface 215B.

Accordingly, as in the first and second exemplary embodiments described above, while a predetermined size as the watch 1B is maintained, desired antimagnetic performance can be ensured.

In the present exemplary embodiment, since the sensor 6B is attached to the case main body 21B, the watch 1B can have a function such as an altitude estimation function, a weather prediction function, a water depth estimation function, a diving information display function, and the like.

Fourth Exemplary Embodiment

Next, a fourth exemplary embodiment will be described based on FIG. 8.

The fourth exemplary embodiment differs from the first exemplary embodiment described above in that a step is provided between an outer surface 214C and an inner surface 215C.

Note that, an identical configuration to that in the first exemplary embodiment will be given an identical reference numeral and detailed description will be omitted.

Figure 8:
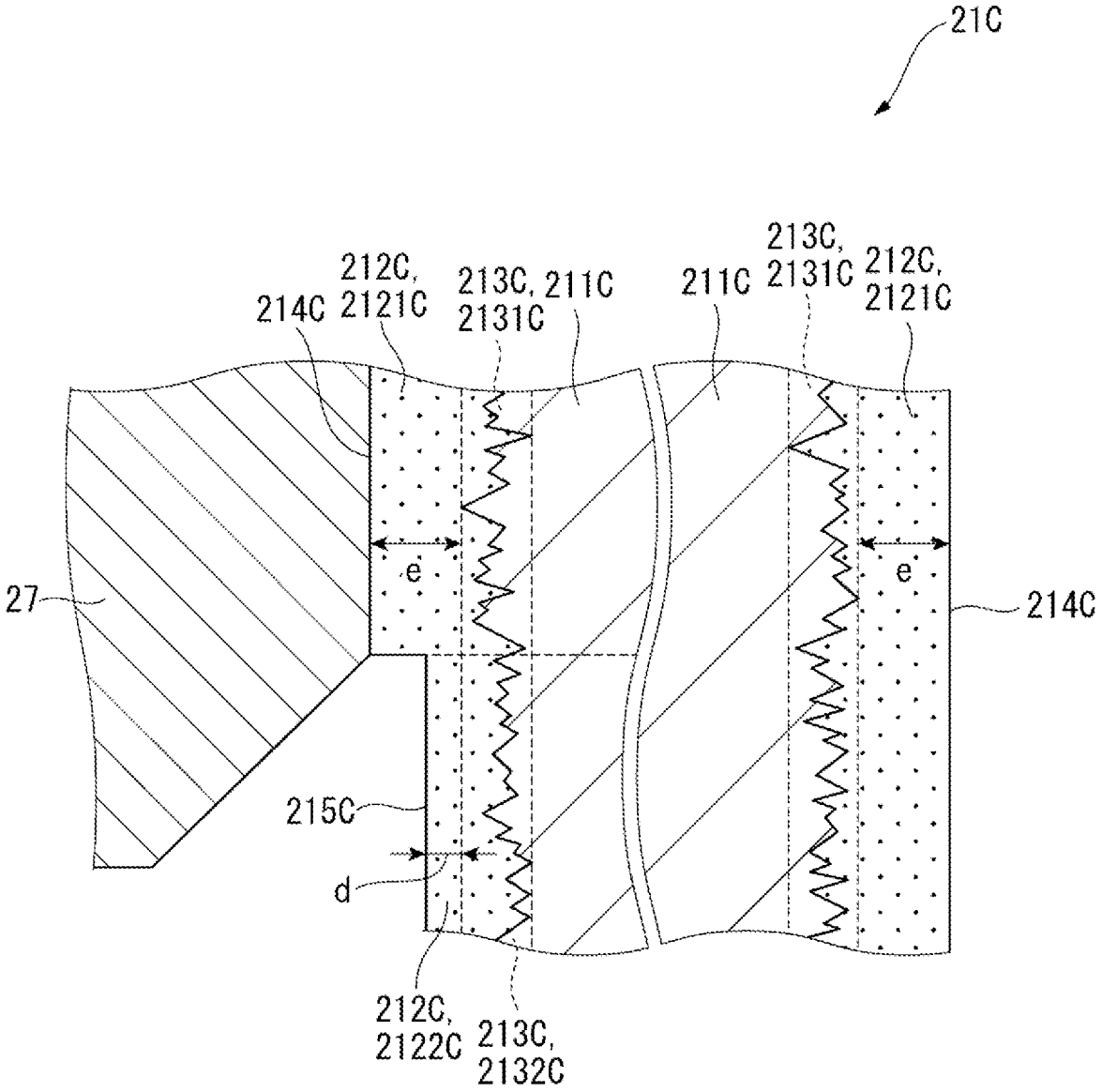
FIG. 8 is a cross-sectional view illustrating a main part of a case main body of a fourth exemplary embodiment.

FIG. 8 is a cross-sectional view illustrating a main part of a case main body 21C of the fourth exemplary embodiment.

As illustrated in FIG. 8, the case main body 21C is formed of ferritic stainless steel including a base 211C formed of a ferrite phase, a surfacing layer 212C formed of an austenitized phase, and a mixed layer 213C in which the ferrite phase and the austenitized phase are mixed with each other.

The base 211C is formed of ferritic stainless steel as in the case of the base 211 of the first exemplary embodiment described above.

Further, similar to the surfacing layer 212 of the first exemplary embodiment described above, the surfacing layer 212C is provided by austenitizing the ferrite phase forming the base 211C.

Further, similar to the mixed layer 213 of the first exemplary embodiment described above, in a step of forming the surfacing layer 212C, the mixed layer 213C is generated by a variation in transfer rate of nitrogen entering the base 211C formed of the ferrite phase. Note that, as in the first exemplary embodiment described above, an outer mixed layer 2131C is provided between the base 211C and an outer surfacing layer 2121C described later, and an inner mixed layer 2132C is provided between the base 211C and an inner surfacing layer 2122C described later.

Here, in the present exemplary embodiment, the surfacing layer 212C includes, similar to the first exemplary embodiment described above, the outer surfacing layer 2121C and the inner surfacing layer 2122C. Additionally, the step is provided between the outer surface 214C of the outer surfacing layer 2121C and the inner surface 215C of the inner surfacing layer 2122C. This is formed, for example, when the case main body 21C is manufactured, by performing cutting such that the inner surfacing layer 2122C is thinner in thickness than the outer surfacing layer 2121C so as to provide a step. In other words, in a first processing step, a base material is formed such that a location corresponding to the outer surfacing layer 2121C and a location corresponding to the inner surfacing layer 2122C are identical in thickness to each other. Then, in a second processing step after a heat treatment step, cutting is performed such that the inner surfacing layer 2122C is larger in amount of cutting than the outer surfacing layer 2121C. Thus, as in the first exemplary embodiment described above, the inner surfacing layer 2122C is provided such that a thickness d is thinner than a thickness e of the outer surfacing layer 2121C. Specifically, the thickness d of the inner surfacing layer 2122C is set to approximately 40 μm, and the thickness e of the outer surfacing layer 2121C is set to approximately 350 μm.

Effects of Fourth Exemplary Embodiment

According to the fourth exemplary embodiment described above, the following advantageous effects can be produced.

In the present exemplary embodiment, the step is provided between the outer surface 214C of the outer surfacing layer 2121C and the inner surface 215C of the inner surfacing layer 2122C. This makes it possible to increase a space inside a watch. Accordingly, a degree of freedom of design of a movement or the like housed in the space inside the watch can be increased.

Modification Example

Note that the present disclosure is not limited to each of the exemplary embodiments described above, and variations, modifications, and the like within the scope in which the object of the present disclosure can be achieved are included in the present disclosure.

In each the exemplary embodiment described above, the watch outer packaging component of the present disclosure is configured as the case main body 21, 21A, 21B, or 21C, but is not limited thereto. For example, the watch outer packaging component of the present disclosure may be configured as at least one of a case back and a bezel. Additionally, the watch may have a plurality of the outer packaging components as described above. Furthermore, the watch outer packaging component of the present disclosure may be a case in which a case main body and a case back are integral.

In the first, second, and fourth exemplary embodiments, each of the case main bodies 21, 21A, and 21C engages with the bezel 23, the crown 26, and the case back 22 via the winding stem pipe 25, the plastic packing 27, and the case back packing 40. Furthermore, in the third exemplary embodiment, the case main body 21B engages with the sensor 6B via the packing 7B, but the present disclosure is not limited thereto. For example, the watch outer packaging component of the present disclosure may engage with at least one of a case back, a crown, a button, a sensor, a dial window, and a bezel.

In the first, second and fourth exemplary embodiments described above, the sealing member of the present disclosure is configured as the winding stem pipe 25, the plastic packing 27, and the case back packing 40, and in the third exemplary embodiment, the sealing member of the present disclosure is configured as the packing 7B, but the present disclosure is not limited thereto. For example, the sealing member may be configured as the plastic packing 28 that secures the bezel 23 and the glass plate 24, a gasket, or the like, and it is sufficient that the sealing member is configured to abut on the watch outer packaging component and to be capable of partitioning the space inside the watch and the space outside the watch.

In each the exemplary embodiment described above, the case main body 21, 21A, 21B, or 21C, is configured as the watch outer packaging component, but is not limited thereto. For example, the case main body may be configured as an outer packaging component of an electronic device other than a watch, that is, a housing of an electronic device, or the like. By providing the housing configured in this manner, desired antimagnetic performance can be secured while a predetermined size is maintained, for the electronic device.

Summary of Present Disclosure

A watch outer packaging component of the present disclosure is a watch outer packaging component formed of austenitized ferritic stainless steel including a base formed of a ferrite phase, and a surfacing layer formed of an austenitized phase in which the ferrite phase is austenitized, and abutting on a sealing member that partitions a space inside a watch and a space outside the watch, wherein the surfacing layer has an outer surfacing layer provided on an outer surface facing the space outside the watch, and an inner surfacing layer provided on an inner surface facing the space inside the watch, and the inner surfacing layer is thinner in thickness than the outer surfacing layer.

Accordingly, the thickness of the inner surfacing layer is reduced, and thus, the outer surfacing layer can be made to have a thickness with which predetermined anticorrosive performance is obtained without increasing a thickness as the watch outer packaging component, and the base can be made to have a thickness with which predetermined antimagnetic performance is obtained. Thus, while maintaining a predetermined size as the watch, desired antimagnetic performance can be ensured.

Furthermore, in the present exemplary embodiment, the thickness of the inner surfacing layer is decreased, thus, for example, a distance between a movement housed in the watch outer packaging component, and the base formed of the ferrite phase can be shortened. Accordingly, influence of an external magnetic field on a motor or the like provided in the movement can be reduced, and the antimagnetic performance can be improved.

In the watch outer packaging component of the present disclosure, the thickness of the inner surfacing layer may be equal to or less than 100 μm.

Accordingly, for example, the distance between the movement housed in the outer packaging component, and the base formed of the ferrite phase can be shortened, thereby improving the antimagnetic performance.

A watch outer packaging component of the present disclosure is a watch outer packaging component formed of austenitized ferritic stainless steel including a base formed of a ferrite phase, and a surfacing layer formed of an austenitized phase in which the ferrite phase is austenitized, and abutting on a sealing member that partitions a space inside a watch and a space outside the watch, wherein the surfacing layer has an outer surfacing layer provided on an outer surface facing the space outside the watch, and the surfacing layer is not provided on an inner surface facing the space inside the watch.

Thus, the outer surfacing layer can be made to have a thickness with which predetermined anticorrosive performance is obtained without increasing a thickness as the watch outer packaging component, and the base can be made to have a thickness with which predetermined antimagnetic performance is obtained.

Thus, while maintaining a predetermined size as the watch, desired antimagnetic performance can be ensured.

In the watch outer packaging component of the present disclosure, a thickness of the outer surfacing layer may be equal to or greater than 100 μm and equal to or less than 600 μm.

Accordingly, the predetermined anticorrosive performance can be ensured, and it is possible to prevent a nitrogen absorption treatment time from becoming too long.

The watch outer packaging component of the present disclosure may be provided with a mixed layer that is formed between the base and the surfacing layer, and in which the ferrite phase and the austenitized phase are mixed with each other.

Accordingly, in nitrogen absorption treatment, a variation in transfer rate of nitrogen can be tolerated, thereby making it possible to facilitate the nitrogen absorption treatment.

In the watch outer packaging component of the present disclosure, the base may contain, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities.

This makes it possible to increase the transfer rate of nitrogen to the ferrite phase, and a diffusion rate of nitrogen in the ferrite phase, in the nitrogen absorption treatment.

In the watch outer packaging component of the present disclosure, a nitrogen content of the surfacing layer may be 1.0 to 1.6% in percent by mass.

Accordingly, anticorrosive performance in the surfacing layer can be improved.

The watch outer packaging component of the present disclosure may engage with at least one of a case back, a crown, a button, a sensor, a dial window, and a bezel, via the sealing member.

A watch outer packaging component of the present disclosure is a watch outer packaging component formed of austenitized ferritic stainless steel including a base formed of a ferrite phase, and a surfacing layer formed of an austenitized phase in which the ferrite phase is austenitized, wherein the surfacing layer has a first surfacing layer provided on an inner surface facing a space inside a watch, and a second surfacing layer provided on an outer surface facing a space outside the watch, and the first surfacing layer is thinner in thickness than the second surfacing layer.

In the watch outer packaging component of the present disclosure, the thickness of the first surfacing layer may be equal to or less than 100 μm.

Accordingly, for example, a distance between a movement housed in the watch outer packaging component, and the base formed of the ferrite phase can be shortened, thereby improving antimagnetic performance.

In the watch outer packaging component of the present disclosure, the thickness of the second surfacing layer may be equal to or greater than 100 μm and equal to or less than 600 μm.

Accordingly, predetermined anticorrosive performance can be ensured, and it is possible to prevent a nitrogen absorption treatment time from becoming too long.

A watch that includes the watch outer packaging component of the present disclosure.

A method for manufacturing a watch outer packaging component of the present disclosure is a method for manufacturing a watch outer packaging component formed of austenitized ferritic stainless steel including a base formed of a ferrite phase, and a surfacing layer formed of an austenitized phase in which the ferrite phase is austenitized, and abutting on a sealing member that partitions a space inside the watch and a space outside the watch, that includes a first processing step of processing ferritic stainless steel to form a base material, a heat treatment step of performing nitrogen absorption treatment on the base material to form the surfacing layer, and a second processing step for cutting the surfacing layer to form the watch outer packaging component, wherein in the second processing step, an inner surfacing layer of the surfacing layer provided on an inner surface facing a space inside the watch is cut so as to be thinner in thickness than an outer surfacing layer provided on an outer surface facing a space outside the watch.

What is claimed is:

1. A watch outer packaging component formed of austenitized ferritic stainless steel including a base formed of a ferrite phase and a surfacing layer formed of an austenitized phase in which the ferrite phase is austenitized, the watch outer packaging component abutting on a sealing member that partitions between a space inside a watch and a space outside the watch, wherein the surfacing layer includes an outer surfacing layer provided at an outer surface facing the space outside the watch, and an inner surfacing layer provided at an inner surface facing the space inside the watch, and the inner surfacing layer is thinner in thickness than the outer surfacing layer.

2. The watch outer packaging component according to claim 1, wherein a thickness of the inner surfacing layer is equal to or less than 100 μm.

3. A watch outer packaging component formed of austenitized ferritic stainless steel including a base formed of a ferrite phase and a surfacing layer formed of an austenitized phase in which the ferrite phase is austenitized, the watch outer packaging component abutting on a sealing member that partitions between a space inside a watch and a space outside the watch, wherein the surfacing layer includes an outer surfacing layer provided at an outer surface facing the space outside the watch, and the surfacing layer is not provided at an inner surface facing the space inside the watch.

4. The watch outer packaging component according to claim 1, wherein a thickness of the outer surfacing layer is from 100 μm to 600 μm.

5. The watch outer packaging component according to claim 3, wherein a thickness of the outer surfacing layer is from 100 μm to 600 μm.

6. The watch outer packaging component according to claim 1, comprising:

a mixed layer that is formed between the base and the surfacing layer, and in which the ferrite phase and the austenitized phase are mixed with each other.

7. The watch outer packaging component according to claim 3, comprising:

a mixed layer that is formed between the base and the surfacing layer, and in which the ferrite phase and the austenitized phase are mixed with each other.

8. The watch outer packaging component according to claim 1, wherein the base contains, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities.

9. The watch outer packaging component according to claim 3, wherein the base contains, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities.

10. The watch outer packaging component according to claim 1, wherein a nitrogen content of the surfacing layer is 1.0 to 1.6% in percent by mass.

11. The watch outer packaging component according to claim 3, wherein a nitrogen content of the surfacing layer is 1.0 to 1.6% in percent by mass.

12. The watch outer packaging component according to claim 1, wherein the watch outer packaging component engages with at least one of a case back, a crown, a button, a sensor, a dial window, and a bezel, via the sealing member.

13. The watch outer packaging component according to claim 3, wherein the watch outer packaging component engages with at least one of a case back, a crown, a button, a sensor, a dial window, and a bezel, via the sealing member.

14. A watch outer packaging component formed of austenitized ferritic stainless steel including a base formed of a ferrite phase and a surfacing layer formed of an austenitized phase in which the ferrite phase is austenitized, wherein the surfacing layer includes a first surfacing layer provided at an inner surface facing a space inside a watch, and a second surfacing layer provided at an outer surface facing a space outside the watch, and the first surfacing layer is thinner in thickness than the second surfacing layer.

15. The watch outer packaging component according to claim 14, wherein a thickness of the first surfacing layer is equal to or less than 100 μm.

16. The watch outer packaging component according to claim 14, wherein a thickness of the second surfacing layer is from 100 μm to 600 μm.

17. The watch outer packaging component according to claim 15, wherein a thickness of the second surfacing layer is from 100 μm to 600 μm.

18. A watch comprising the watch outer packaging component according to claim 1.

19. A watch comprising the watch outer packaging component according to claim 3.

20. A watch comprising the watch outer packaging component according to claim 14.

* * * * *